United States Patent [19]

Argandona

[11] Patent Number: 4,491,147

[45] Date of Patent: Jan. 1, 1985

[54] FILLBOX FOR STORAGE TANK INLET

[76] Inventor: Toby Argandona, 21221 Running Branch Rd., Diamond Bar, Calif. 91765

[21] Appl. No.: 413,671

[22] Filed: Sep. 1, 1982

[51] Int. Cl.[3] ..... F16L 5/00

[52] U.S. Cl. ..... 137/371; 137/381; 220/3.7; 220/3.8; 220/18

[58] Field of Search ..... 137/363, 367, 371, 377, 137/372, 381; 220/3.7, 3.8, 8, 18; 206/815

[56] References Cited

U.S. PATENT DOCUMENTS

| | | | |
|---|---|---|---|
| 3,263,853 | 8/1966 | Smith | 220/18 |
| 3,561,470 | 2/1971 | Hawle | 137/371 |
| 3,611,889 | 10/1971 | Levinson | 220/3.7 |
| 3,952,908 | 4/1976 | Carson | 220/3.8 |
| 4,065,020 | 12/1977 | Carson | 220/3.8 |
| 4,153,176 | 5/1979 | Carson | 220/18 |
| 4,163,503 | 8/1979 | McKinnon | 137/371 |
| 4,350,177 | 9/1982 | Firchau et al. | 137/371 |

*Primary Examiner*—A. Michael Chambers
*Attorney, Agent, or Firm*—Boniard I. Brown

[57] ABSTRACT

A fillbox system to prevent water from entering the below ground level inlet of an input stand pipe for an underground fuel storage tank. The system includes a fillbox about the inlet stand pipe which extends upwardly therein and a fillbox cover having a downwardly extending skirt which extends almost to the bottom of the fillbox. The skirt, generally has the same outer shape as the inner sides of the fillbox but a slightly smaller dimension than that of the fillbox adjacent the cover. The skirt has a small inward draft angle as it extends downwardly about the stand pipe so that when placed on the fillbox, the cover is guided by the skirt into a proper seating relationship. At the same time, the skirt and cover trap enough air therewithin so that the level of water seeping in the fillbox can never exceed a volume that would produce a water height above the inlet with the cover removed to leak into the underground storage tank when the inlet is opened.

17 Claims, 4 Drawing Figures

FILLBOX FOR STORAGE TANK INLET

BACKGROUND OF THE PRESENT INVENTION

At service stations and other fueling facilities, it is common to place fuel storage tanks in underground locations with the storage tank inlet stand pipes extending upwardly to just below ground level. The input end of such stand pipes normally is surrounded by a fillbox which is, in essence, an open ended cube or cylinder having an upwardly facing lip for receiving a cover. Unfortunately, because of the heavy vehicle traffic over the cover, it is difficult or impossible to provide an economical seal between the cover and the fillbox. Therefore, rain water, wash water or other fluid contaminants in the area can flow into the fillbox. If the quantity of the fluid is sufficient, its fluid level can extend above the input in the fillbox for a substantial period even though the fluid is draining out through the earth at the open bottom of the fillbox. If the inlet is then opened, the water runs down the stand pipe into the storage tank where it gravitates to the bottom of the tank. Since in conventional present-day arrangements, fuel is pumped from the bottom of the tank, soon thereafter the water is introduced into vehicle fuel tanks causing sputtering, stalling, and starting problems to the vehicle owners as well as cheating them by selling them water instead of fuel. To reduce this problem, the oil company supplying the fuel, must provide maintenance personnel and equipment to pump the fluid out of the fillboxs at considerable expense, and from tanks.

Another solution is to place the inlet above ground. However, this makes gravity transfer of fuel inconvenient. It also is desirable that the inlet be placed in a fillbox and be located slightly underground so that errant vehicles cannot strike it to cause structural damage to the underground tanks or fire.

Therefore there has been a need for a fillbox cover which prevents the entry of fluid contaminants into the fillbox in sufficient quantity to cause overflow of the inlet and the introduction of water into the underground storage tank when the inlet is opened.

BRIEF DESCRIPTION OF THE PRESENT INVENTION

To overcome the aforementioned problems, the present invention includes a special fillbox cover. The fillbox itself normally is comprised of a rectangular box with a top open to the atmosphere, a bottom open on the ground to allow water seepage thereout, and a lip for the support of a cover. The inlet pipe for underground storage tank extends upwardly centrally within the fillbox to a level slightly below the level defined by the lip. The present cover is designed to fit nearly across the top of the fillbox, engaging a major portion of the fillbox cover lip thereabout but having a slight relief from the upward sides of the fillbox which extend from the lip to ground level. On the downward side of the fillbox cover, a downwardly extending skirt is positioned in close proximity to the sidewalls of the fillbox and is generally of the same shape. A small draft angle is provided on the skirt so that the lower portion of the skirt is slightly further away from the fillbox walls than the upper portion attached to the cover. The draft angle assures that once the cover is placed back on the fillbox, the skirt guides the cover to a proper position seating 360° around on the lip. Although the volume bounded by the skirt and the cover is open on the bottom so that the inlet stand pipe can extend upwardly therein, the volume is in fact sealed on the top and the sides so that air trapped thereunder prevents the level of any water therein from rising a substantial distance. By the proper relative sizing of the skirt and the fillbox, the amount of water within the fillbox can be kept sufficiently small that it remains below the inlet to the pipe when the cover is removed.

Therefore it is an object of the present invention to provide means to eliminate the need for pumping out underground fillboxes prior to the filling of underground storage tanks through inlet pipes in the fillboxs.

Another object is to provide means to cover service station fillboxes which eliminate the changes of a fillbox cover popping up to damage the vehicle passing thereover.

Another object is to provide an improved fillbox cover for retrofitting the fillboxes of existing service stations to prevent water from undesirably entering underground fuel storage tanks.

Another object is to provide a fuel inlet fillbox cover which is self-centering and eliminates the possibility of bending due to heavy vehicle traffic thereover due to improper installation.

These and other objects and advantages of the present invention will become apparent to those skilled in the art after considering the following detailed specification in conjunction with the accompanying drawing wherein:

DETAILED DESCRIPTION OF THE SHOWN EMBODIMENT

Figure 1:
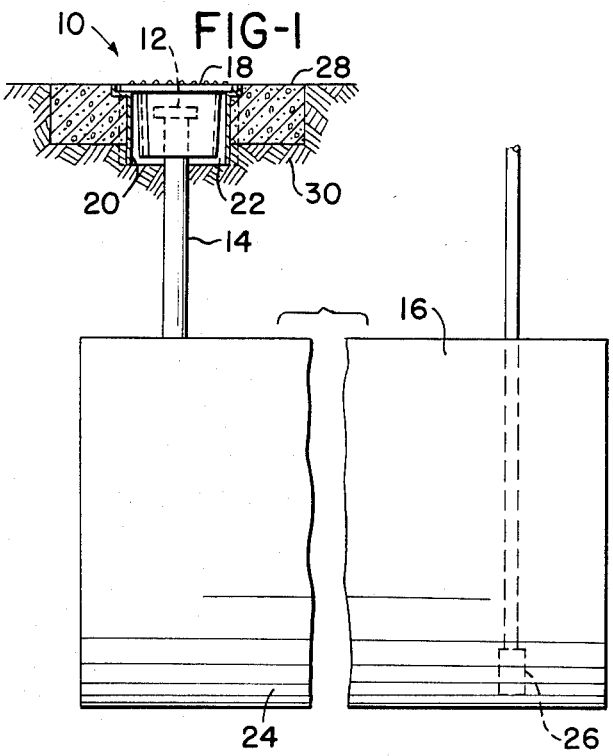
FIG. 1 is a diagrammatic representation, partially in cross section, of the general arrangement of a fillbox cover and underground fuel storage tank.

Referring to the drawing more particularly by reference numbers, number 10 in FIG. 1 refers to a fillbox system for preventing water from entering the inlet 12 of the input stand pipe 14 of an underground storage tank 16 commonly used to dispense gasoline and diesel fuel. The system 10 is designed to assure that the cover 18 remains in its proper position protecting the stand pipe 14 surrounded by a fillbox 20, and to prevent water from accumulating in sufficient quantity within the interior 22 of the fillbox 20 to overflow the inlet 12 of the input stand pipe 14 when the cover 18 is removed at the inlet 12 and is opened for adding fuel to the tank 16. This is important, since water is normally heavier than fuel. The water accumulates in the bottom 24 of the tank 16 where it readily enters the outlet 26 normally positioned within the tank 16 at the bottom 24 to be dispensed along with the fuel to the ultimate users.

Figure 3:
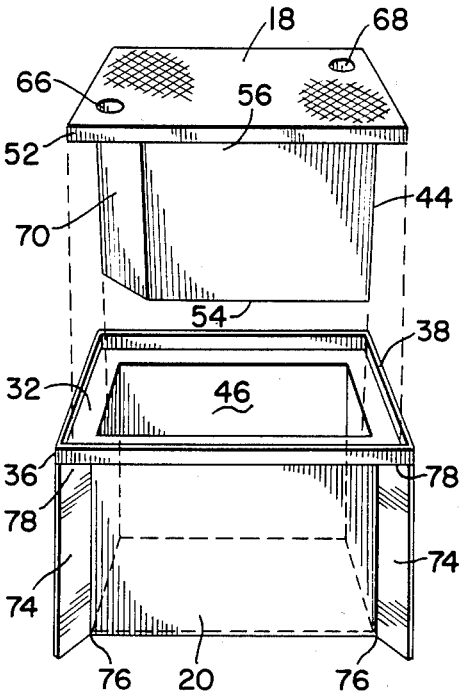
FIG. 3 is an exploded perspective view of the fillbox and cover therefor.
Figure 2:
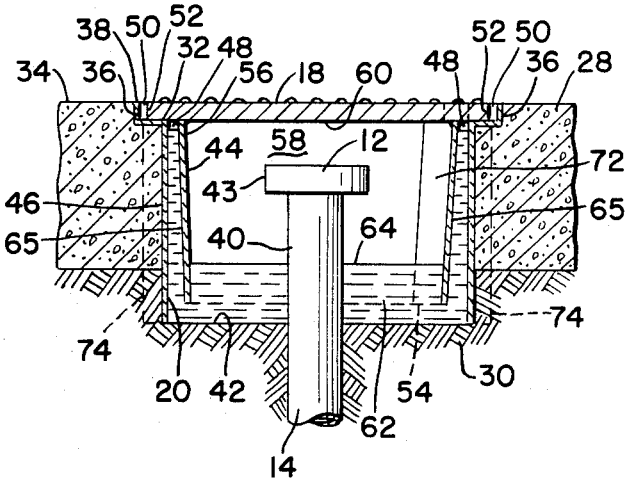
FIG. 2 is an enlarged cross-sectional view of the fillbox with its enclosed inlet stand pipe of FIG. 1.

The fillbox 20, as typically positioned extending through a concrete slab 28 to the earth 30 below, is shown in enlarged cross-section in FIG. 2. The fillbox 20 includes an upwardly facing lip surface 32 positioned a predetermined distance below the upper surface 34 of the concrete slab 28. The lip 32 is surrounded by an upwardly extending flange 36 whose upper surface 38 essentially is even with the upper surface 34 of the slab 28. The flange 36 and lip 32 are shown in FIG. 3 to have a square shape. However, other symmetrical shapes, such as circles, equilateral triangles or other regular polygons are suitable. As can be seen in FIG. 2, the fillbox surrounds a predetermined top portion 40 of the stand pipe 14 from ground level 42 within the fillbox 20 to the inlet cap 43.

The cover 18 includes a downwardly extending skirt 44 which has a shape similar to that of the sidewalls 46 of the fillbox 20 below its lip surface 32. The skirt 44 is sized adjacent the cover 18 so that a small predetermined clearance 48 exists between the skirt 44 and the sidewalls 46. This predetermined clearance 48 is small enough, with respect to the clearance 50 between the flange 36 and the outer edge 52 of the cover 18, that a slight outward draft angle on the skirt from the bottom 54 to the top 56 thereof tends to slide the cover 18 sidewardly as the cover 18 is lowered onto the fillbox 20. This prevents the cover 18 from ever cocking and being supported in part by the upper surface 38 of the flange 36. This is important since cocking can produce high stresses in the cover 18 when heavy vehicles roll thereover, bending the cover 18 so that it can never properly fit on the fillbox 20 thereafter. Therefore, the skirt 44 guards against negligent replacement of the cover 18.

The skirt 44 is welded to the cover about its top 56 and sealed thereto. Therefore a chamber 58 is formed between the lower surface 60 of the cover 18 and the skirt 44. The chamber 58 has an open bottom so that the stand pipe 14 can extend upwardly therein as shown. When in place, should ground water somehow get introduced onto the surface 34 to run around the cover 18 and into the fillbox 20, the surface level 64 of the water 62 is prevented from rising to the inlet 12 by air trapped within the chamber 58 and compressed by the slight upward movement of the water surface level 64. The actual highest surface level 64 possible depends upon the head of water above the surface 34. However, since no attempt will ever be made to fill the underground tank 16 when flood conditions exist, and properly designed surface drainage should prevent more than a small accumulation of water at the surface 34, the head of water along the outside 65 of the skirt 44 never is sufficient to cause the level 64 to extend very high up within the interior of the chamber 58.

The volume between the fillbox 20 and the outer surface 65 of the skirt 44 is purposely relatively small so that when the cover 18 with its skirt 44 are removed for filling through the inlet 12, the water level 64 raises only slightly. This assures that water is not introduced into the fill pipe 14. Of course, should any additional ground water flow into the fillbox when the cover 18 is removed, it will be forced out when the cap 43 and cover 18 are replaced since air will again be compressed within the chamber 58 until the compression of the air reaches equilibrium with the head of the water surrounding the skirt 44.

Figure 4:
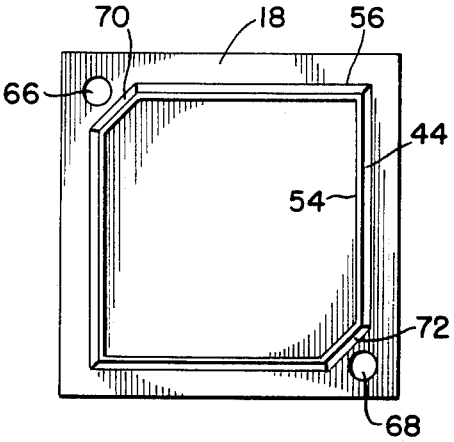
FIG. 4 is a bottom view of the cover of FIGS. 1, 2 and 3.

There must be means to remove the cover 18 conveniently and these are shown as hook holes 66 and 68 in FIG. 3. Suitable angled reliefs 70 and 72 are provided so that the holes 66 and 68 do not destroy the integrity of the chamber 58. The slight additional volume of water storable in the fillbox due to the reliefs 70 and 72, their inclusion eliminating the matching nature of the skirt 44 to the fillbox 20 at the opposite diagonal corners thereof, can be accommodated easily by properly designing the extending of the skirt 44 downwardly and by assuring that the percentage volume within the chamber 58 is sufficient to accommodate this additional water. The actual volume increase caused by the reliefs 70 and 72 can be visualized from FIG. 4 which also allows visualization of the inward draft angle of the skirt 44 as it extends downwardly from the cover 18.

As aforesaid, it is possible to bend a cover 18 if it is not properly supported. The fillbox 20 can be modified as shown in FIG. 3 to include radially outwardly extending diagonal ribs 74 on the corners 76 thereof. The ribs 74 extend upwardly to support the undersurface 78 of the fillbox 20 beneath the lip surface 32 even though this surface 78 is also supported by the concrete slab 28.

Therefore, there has been shown and described a novel fillbox cover and foolproof fillbox system which prevents water from entering the input stand pipe of an underground fuel storage tank and which fulfills all the objects and advantages sought therefor. Many changes, alterations, modifications and other uses and applications of the subject invention will become apparent to those skilled in the art after considering this specification together with the accompany drawing. All such changes, alterations, and modifications which do not depart from the spirit and scope of the invention are deemed to be covered by the invention which is limited only by the claims which follow.

What is claimed is:

1. A fillbox system for preventing undesirable liquid contamination of an underground inlet of a fluid storage tank by liquid accumulated above a ground level within the fillbox and below said inlet, said system including:

a fillbox cover plate adapted for closing off a fillbox upper opening and having a lower surface and an outer edge surface; and a 360° skirt depending from said lower cover plate surface spaced inwardly from said outer edge surface, said cover plate lower surface and depending skirt being configurated and sized to cooperate with said liquid accumulated above said ground level to define a space within which to trap such a volume of air therein when positioned about the inlet as to prevent sufficient liquid from accumulating within the fillbox above said ground level therein to overflow the inlet when said fillbox cover plate and 360° skirt are removed.

2. The system as defined in claim 1 wherein said 360° skirt extends downwardly from the cover plate at a draft angle extending radially inwardly in the direction from the plate.

3. The system as defined in claim 2 wherein said fillbox cover plate defines:

a pair of hook holes therethrough, said hook holes being positioned between said 360° skirt and said outer edge surface.

4. The system as defined in claim 3 wherein said 360° skirt includes reliefs adjacent said hook holes.

5. A fillbox system according to claim 4, wherein:

said skirt has a peripheral configuration generally like that of the side walls of the fillbox.

6. The system as defined in claim 2 further including:

a sealable underground tank inlet; and a fillbox, said fillbox having:

an upwardly facing lip sized to support said cover plate adjacent said outer edge thereof;

at least one sidewall sized to encircle said underground tank inlet and said skirt when said skirt is positioned therein, a first predetermined clearance being defined between said sidewall and said fillbox sidewall when said cover plate is supported by said lip; and an upwardly extending flange outwardly bounding said upwardly facing lip, a second predetermined clearance being defined between said cover plate outer edge surface and said upwardly extending flange which is greater than said first predetermined clearance.

7. The system as defined in claim 6 wherein said fillbox cover plate is square in shape and said upwardly facing lip is a square ring in shape.

8. The system as defined in claim 7 wherein said fillbox cover plate defines:

a pair of hook holes therethrough, said hook holes being positioned between said 360° skirt and said outer edge surface at opposite diagonal corners thereof.

9. The system as defined in claim 8 wherein said skirt is generally square in cross-section having opposite diagonal corners adjacent said hook holes which include a generally 45° relief surface so that said hook holes do not extend within said skirt.

10. The system as defined in claim 9 wherein said fillbox includes radially outwardly extending ribs positioned at the corners thereof in diagonal alignment, said ribs being connected to said lip to provide support thereto.

11. A fillbox system according to claim 6, wherein:

said skirt has its lower edge portion adjacent to said ground level within the fillbox.

12. A fillbox system according to claim 6, wherein:

said skirt has a peripheral configuration generally like that of the side walls of the fillbox.

13. The system as defined in claim 2 wherein said radially inwardly extending draft angle of said skirt is about 5°.

14. A fillbox system according to claim 2, wherein:

said skirt has its lower edge portion adjacent to said ground level within the fillbox.

15. A fillbox system according to claim 2, wherein:

said skirt has a peripheral configuration generally like that of the side walls of the fillbox.

16. A fillbox system according to claim 1, wherein:

said skirt has its lower edge portion adjacent to said ground level within the fillbox.

17. A fillbox system according to claim 1, wherein:

said skirt has a peripheral configuration generally like that of the side walls of the fillbox.

* * * * *